United States Patent [19]

Bridges et al.

[11] 4,235,493

[45] Nov. 25, 1980

[54] KNOCKDOWN CABINET ASSEMBLY

[75] Inventors: David F. Bridges; Alton H. Britt, Jr., both of Cleveland, Miss.

[73] Assignee: Chromalloy American Corporation, St. Louis, Mo.

[21] Appl. No.: 968,448

[22] Filed: Dec. 11, 1978

[51] Int. Cl.[3] ..... A47B 43/00

[52] U.S. Cl. ..... 312/257 R; 312/257 SK; 312/263; 312/111; 108/109

[58] Field of Search ..... 312/257 R, 257 SK, 257 A, 312/257 SM, 108, 107, 111, 263; 108/109; 16/135

[56] References Cited

U.S. PATENT DOCUMENTS

| | | | |
|---|---|---|---|
| 2,375,726 | 5/1945 | Bales | 108/109 |
| 2,443,516 | 6/1948 | Rockwell | 16/135 |
| 2,701,174 | 2/1955 | Franks | 312/263 |
| 2,905,519 | 9/1959 | O'Neil | 312/111 |
| 3,199,683 | 8/1965 | Graswich | 108/109 |
| 3,497,279 | 2/1970 | Chovanec | 312/257 R |
| 3,989,772 | 6/1976 | Parsons | 16/135 |
| 4,040,694 | 8/1977 | Lascarrou | 312/263 |

FOREIGN PATENT DOCUMENTS

| | | | |
|---|---|---|---|
| 1249478 | 9/1967 | Fed. Rep. of Germany | 312/257 R |
| 2430676 | 6/1974 | Fed. Rep. of Germany | 312/257 SK |
| 1514174 | 1/1968 | France | 312/257 SK |

*Primary Examiner*—Victor N. Sakran

*Attorney, Agent, or Firm*—Haverstock, Garrett & Roberts

[57] ABSTRACT

A composite wood and metal knockdown cabinet assembly is characterized by component parts which can be assembled by the user merely with the aid of a screwdriver. The component parts of the assembly comprise a pair of prefabricated sheet metal side frames each composed of a rear and front vertical metal member which are each end-lap fastened at or near each end to horizontal metal U channel members, horizontal wood braces across the front of the cabinet end-lap fastened to the front vertical members of the side frames, one or more drawers and/or wood shelves supported by all the vertical members of the side frames and optionally wood door hinges attached conjointly to a front metal vertical member and to a horizontal front wood or metal brace. The pair of sheet metal side frames can be used to assemble cabinets of any desired width and/or number of shelves or drawers, or combinations of drawers and shelves. There is also disclosed an improved hinge for mounting a door on the cabinet and an improved combination wood and metal drawer. Additionally, the sheet metal side frames have provisions permitting individual cabinets to be joined together into a row of cabinets of any desired length and to be precisely vertically aligned with each other. Another disclosed feature of the sheet metal side frames are height adjustable shelf supporting means which in conjunction with shelves having unique corner configurations enable the shelves in one cabinet to be positioned in abutting relationship to the shelves of adjacent cabinets and thus provide if desired a substantially continuous horizontal shelf area extending along the entire length of a row of mounted cabinets. Another disclosed feature is the provision of particular metal brackets and clamps cooperating with the cabinet's metal side frames and top panel for respectively hanging and clamping the wall cabinets against a wall surface which enable mounting of the cabinets in most instances (depending on the weight of a given cabinet) by an individual without the aid of others or the need for interim scaffolding.

10 Claims, 21 Drawing Figures

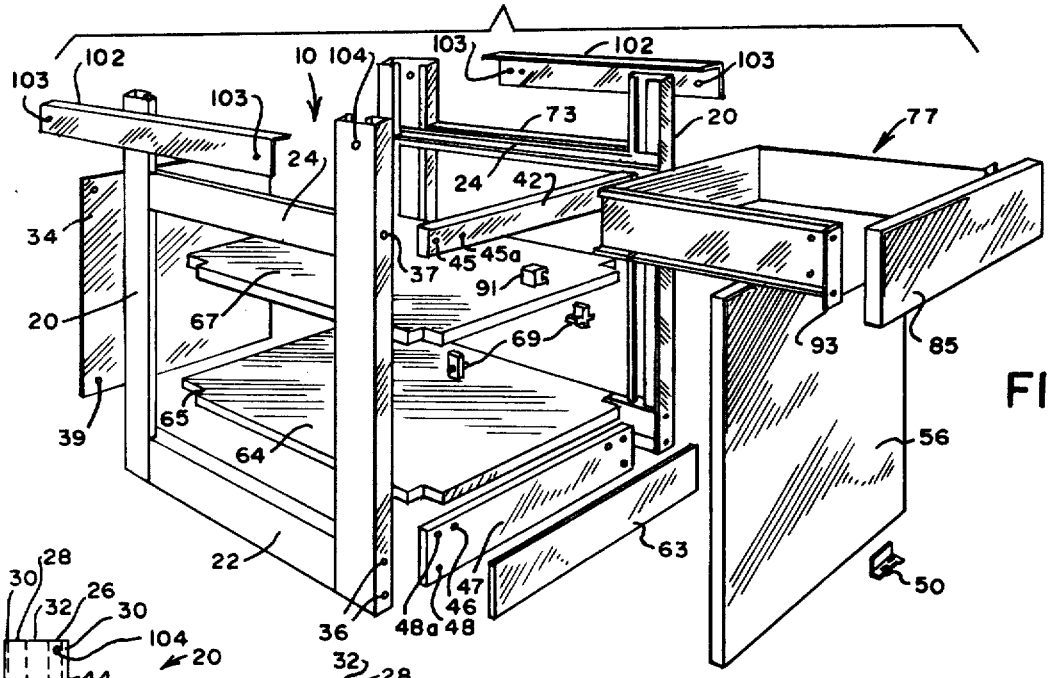
FIG. 1
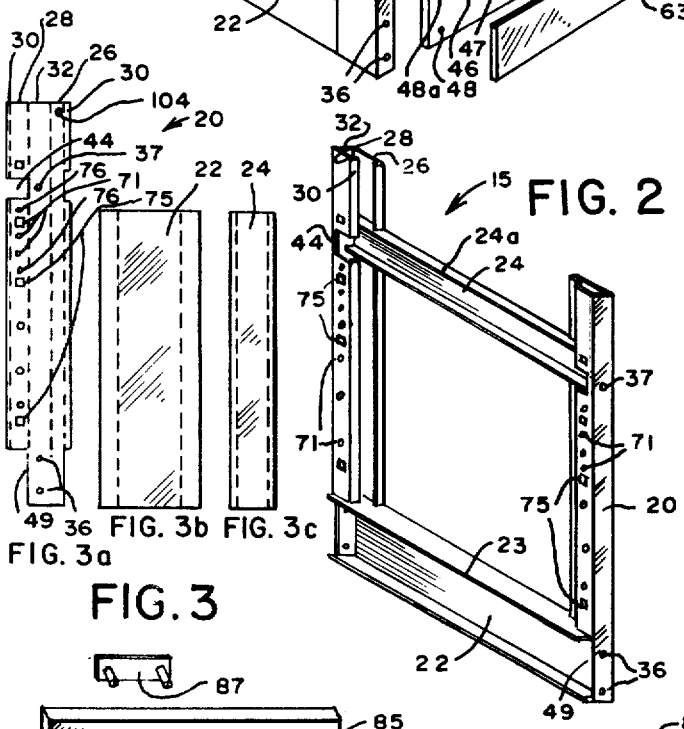
FIG. 2
FIG. 3a FIG. 3b FIG. 3c
FIG. 3
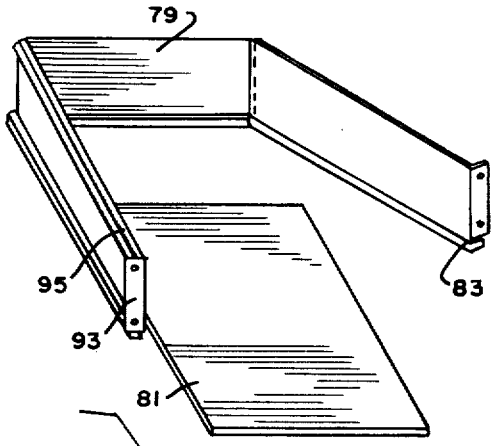
FIG. 4b.
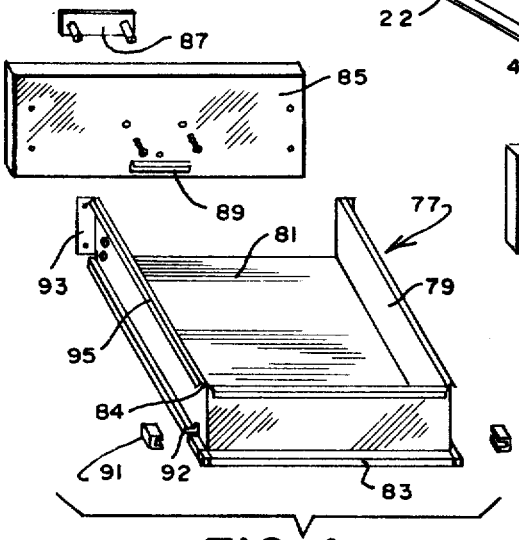
FIG. 4.
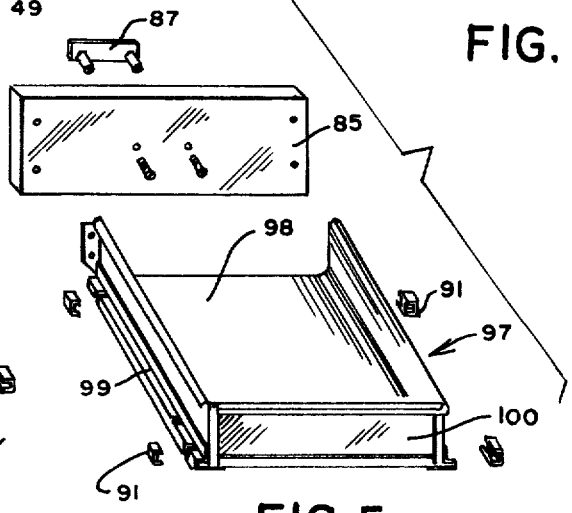
FIG. 5.

KNOCKDOWN CABINET ASSEMBLY

BACKGROUND OF THE INVENTION

1. Field of the Invention

This invention relates to an improved cabinet assembly of the knockdown type and is particularly directed to a composite wood end metal cabinet assembly wherein a pair of sheet metal side frames of a novel configuration establishes a rigid frame construction for supporting shelves and/or drawers and optionally doors and wherein the outer faces of the cabinet's drawers and doors have aesthetically pleasing wood or simulated wood surfaces.

2. Description of the Prior Art

Knockdown type cabinets of all metal construction, all wood or of wood and metal construction have been known for a number of years. The individual components of such cabinets as packaged for shipment to the ultimate user are a fraction of the bulk of factory assembled cabinets and thus their shipping costs are more economical. Final assembly of the cabinets is relatively easy in the instance of the all metal type knockdown cabinets as in most instances their individual parts are easily fastened together by nuts and bolts. Knockdown cabinets of all wood construction offer the most difficulty in assembly and usually require glue or other adhesives to hold together the framing members or special clamping fixtures in order to effect acceptable alignment of the individual parts. Moreover the wood framing members of all wood knockdown type cabinets may shrink or warp on aging or split from improper screw insertion. Assembly of combination wood and metal knockdown cabinets compares favorably with the all metal knockdown cabinets but the cabinets of this type do not provide for adjustable positioning of shelves or drawers, or for a combination of shelves or drawers, or for a combination of drawers and shelves in the same cabinet.

Accordingly a major object of this invention is to provide composite wood and metal knockdown cabinet assembly having metal side frames adapted to accommodate without change or further modification thereto either a plurality of shelves, or of drawers, or a combination of shelves and drawers and which can be readily assembled by the user merely with the aid of a screwdriver.

A further object of this invention is to provide a composite wood and metal knockdown cabinet assembly wherein a pair of metal side frames and wood or metal cross-bracing result in an assembled cabinet characterized by structural rigidly and precise alignment.

A still further object of this invention is to provide a composite wood and metal knockdown cabinet assembly having aesthetically pleasing wood exterior facings while substantially retaining the structural strength and rigidity of an all metal knockdown cabinet.

A still further object of this invention is to provide a knockdown metal and wood drawer assembly having a wood drawer front.

A still further object of this invention is to provide door hinges for the composite wood and metal cabinet assembly functioning as connectors for the metal side frames and the horizontal wood bracing.

Another object of this invention is to provide a composite wood and metal knockdown cabinet assembly which does not require messy glues or adhesives or clamps to insure a precision aligned assembled cabinet structure capable of satisfactorily supporting customary loading of its shelves and/or drawers.

It is still another object of this invention to provide cabinets having sheet metal side frames enabling a plurality of assembled wood and metal cabinets to be positioned in a row of any desired length and fastened together in precise vertical alignment against a wall surface.

Yet another object of this invention is to provide in a composite wood and metal cabinet assembly shelving of such configuration that when installed in a row of parallel mounted cabinets, the shelves in each cabinet can abut against the side edges of shelves in adjacent cabinets and thereby provide a substantially continuous surface for articles having a longer length than the width of an individual cabinet.

A still further object of this invention is to provide metal hangers and brackets for securely attaching the composite wood and metal wall cabinet assemblies against a wall surface whereby but one person in most instances is able to install the cabinets without requiring help from another person or construction of interim scaffolding.

SUMMARY OF THE INVENTION

This invention is directed to improvements in knockdown composite wood and metal cabinets which can be readily assembled and then installed by relatively unskilled persons in homes, offices, stores, laboratories, garages and any other places having a need for cabinets characterized by precision alignment, structural strength and rigidily of the assembled cabinet. The invention includes per cabinet a pair of rectangular shape sheet metal side frames preassembled at the factory each from a pair of spaced vertical members having a particular modified U shaped cross-section and that are lap joined together at their lower and upper ends by respective lower and upper horizontal members having a U shaped cross-section. At the cabinet assembly side, the side frames are attached to front upper and lower metal or wood cross braces, the ends of each cross brace being inserted into the U channels of the metal frames horizontal members and a back panel is attached to the rear surfaces of the metal side frames. Upon completion of the assembly of the aforementioned components, there is obtained an aligned structure highly resistant to shape distortion. Inherent features of the sheet metal side frames provide the assembler with a choice in going ahead with the assembly of a cabinet containing only shelves, or only drawers or any combination of shelves and drawers. Doors to enclose shelf areas of the cabinet are pivotally attached by semi-concealed hinges fastened to the front surface of a metal side frame and in addition to a front cross brace to further enhance the structural rigidity of the cabinet. Shelves for use in the cabinets have unique corner configurations to interlock with surfaces of the vertical members of the metal side frame in order that the shelves after installation are restrained from fore and aft movement as well as side to side movement. The corner configuration of the shelves can be further modified to provide for shelves in adjacent cabinets to abut against each other to form a substantially continuous shelf area extending through a plurality of adjacently mounted cabinets. Additionally there are disclosed metal hangers for supporting wall cabinets on a wall surface, said brackets having an upturned flange for engagement with a slot in the bottom surface of a rear horizontal cross brace and metal clamps wherein one end flange thereof is bent around a portion of a rear vertical member of the side frame and the other end flange running parallel to the wall surface has a terminal right angle lip bearing against the front surface of the back panel, said second flange having an aperture permitting entry of a screw for attachment of the clamp to the wall surface. The vertical members of the metal side frames have spaced apertures along their length enabling adjacent cabinets to be bolted together in a precise vertical aligned manner to form a continuous row of cabinets.

BRIEF DESCRIPTION OF THE DRAWINGS

These and other objects and attendant improvements of the present invention will become cognizant by reference to the subsequent detailed description taken in conjunction with the accompanying drawings wherein:

FIG. 1 is an exploded view of the components constituting an embodiment of this invention in the form of a base cabinet containing a drawer, a shelf and a door enclosing the shelf portion of the cabinet;

FIG. 2 is a perspective view of a prefabricated sheet metal side frame employed in the construction of the base cabinet illustrated in FIG. 1;

FIGS. 3*a*, 3*b*, and 3*c* are respectively plan views of the sheet metal blanks prior to being shaped as by bending to form the vertical members; the bottom cross brace and the upper cross brace of the side frame illustrated in FIG. 2;

FIG. 4 is a perspective view of a combination wood and metal drawer assembly taken from the rear of the drawer;

FIG. 4*b* is another perspective view of the drawer illustrated in FIG. 4 taken from the front of the drawer and illustrating the manner in which the drawer bottom is inserted into the sheet metal side frame;

FIG. 5 is a perspective view taken from the rear of a conventional sheet metal drawer having a wood drawer front;

Referring now to FIGS. 1 to 8 and 16 illustrating a preferred embodiment of the invention as incorporated in a base cabinet assembly, attention is initially directed to FIGS. 2, 3*a*, 3*b* and 3*c* illustrating novel features in the design of the cabinets sheet metal side frame, generally indicated by the reference character 15. In the subsequent description it is to be understood that like reference characters refer in all instances to like parts. The sheet metal side frame 15 is a factory prefabricated structure comprising parallel spaced vertical members 20, lower U channel member 22 and upper U channel member 24, each horizontally bridging the space between vertical members 20. As shown in FIGS. 1 and 2 each vertical member 20 has along a major portion of its length a modified U shaped cross section wherein one leg 26 of the U is longer than the other leg 28 of the U and that each leg has a terminal right angle bend 30 extending partly across the base 32 of the U and parallel thereto. Provisions are made at the upper portion of vertical member 20 and again at its bottom end to enable respectively upper channel cross-brace 24 and lower channel cross-brace 22 to be end-lap fastened, as by resistance welding, to interior surface, of the long U leg 26 of vertical member 20. Such provisions include elimination of the right angle bend 30 on the longer leg 26 of the U for a distance along the length of vertical member 20 corresponding to the width of the U channel cross-braces 22 and 24 whereby the exterior surfaces of cross-braces 22 and 24 at each end portion can be lap positioned against the interior surface of the longer leg 26 of the U cross-section of vertical member 20 and with the terminal ends of each U channel cross-brace 22 and 24 abutting against the interior surface of the U base 32 in vertical member 20. When either U channel crossbrace 22 or 24 has side walls of greater width than the U base 32 of vertical member 20, then as most clearly shown in FIG. 2 in the instance of bottom U channel cross-brace 22 having a side wall of greater width than U base 32 in vertical member 20 in addition to the elimination of the right angle bend 30 on the longer U leg 26 of vertical member 20, elimination is also required of a corresponding length of the shorter leg 28 of vertical member 20. Having bottom U channel crossbrace 22 with wider side walls than upper U channel cross brace 24 is an optional feature utilitzed when it is desired to increase the base footing area of the cabinet in order to diminish loading per unit floor area space. The flat sheet metal blank 20 as shown in FIG. 3*a* has been stamped out to eliminate those portions which would interfere with endlap fastening of the U channel cross braces 22 and 24. The dotted lines in FIG. 3*a* indicate where the sheet metal would be bent to form the aforesaid modified U shaped cross-section. The U channel cross-braces 22 and 24 are simple shapes respectively formed by bending along the dotted lines the flat sheet metal blanks illustrated in FIGS. 3*b* and 3*c*.

Figure 6:
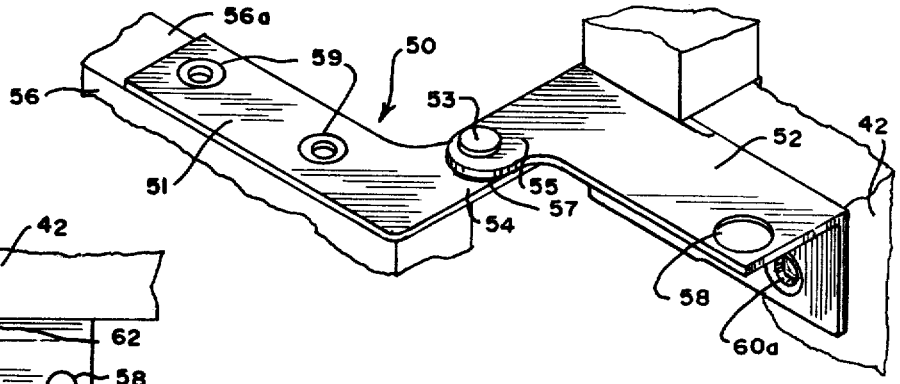
FIG. 6 is a partially fragmented perspective view of a preferred hinge for attachment of a door to the cabinet frame members.

Upon the welding together of the two vertical members 20 to the end sections of the U channel cross-braces 22 and 24, one obtains a unitary sheet metal frame highly resistant to compression or bending stresses, and capable of satisfactorily supporting with minimum deflection all normal loads placed on the shelves or in the drawers within their designed use. Nominally 24 gauge steel sheet is of adequate strength and the rigidity for use in forming adequately strong side frames 15, but even lighter gauge sheet steel can be used when the cabinets assembled therefrom are to meet with less rigorous use conditions. Extruded aluminum shapes can also be used as functional equivalents of the sheet metal vertical members 20 and the cross-braces 22 and 24 when the higher costs of aluminum shapes are acceptable in view of their resistance to corrosion and greater stiffness per unit weight.

Assembly of the base cabinet can be conveniently inititated by attaching cross-bracing rear panel 34 which may be of sheet metal, plastic laminate, plywood, fiber board or the like by sheet metal screws (not shown) to the rear edges of side metal frames 15, the screws first entering apertures 39 in the rear panel 34 and then into predrilled screw apertures (not shown) in vertical member 20. In the next step, front upper cross-brace 42 which may be of wood or metal is positioned between opposed metal side frames 15, 15 in such manner that each end portion thereof enters a slot 44 formed in vertical member 20 by removal of its short U leg 28 for a distance corresponding to the vertical width of front top cross-brace 42 and abuts against the interior surface at the U base of upper U channel cross brace 22. The front top cross-brace 42 is then fastened against the interior surface of the U base 32 of each vertical member 15 by a screw (not shown) passing first through aperture 37 in vertical member 15 and then into aperture 45 in front top cross-brace 42, whereby two surfaces (one side and one end) of front top cross brace 42 contact two planar interior surfaces of upper U channel side cross brace 24 and the interior surface at the U base 32 of vertical member 20 thereby insuring structural rigidity of side frame 15. One of the screws for insertion in aperture 37 of vertical member 20 on the hinge side of the frame is not tightened at this stage of assembly as will be explained later. In the next assembly operation front bottom cross-brace 47 of wood or metal is similarly positioned between opposed metal side frames 15, 15; it has a vertical width corresponding to the interior vertical width of lower side U channel brace 22. Accordingly, when front bottom cross-brace 47 end portion is fully inserted through slot 49 formed in vertical member 20 by removal of its shorter U leg 28 to abut against the interior U base of lower U channel side cross brace 22, four surfaces of front bottom cross-brace 47 (three sides and one end) are in contact with three interior planar surfaces of side cross-brace 22 and one interior surface of vertical member 20 being the U base 32 of vertical member 20. Screws (not shown) passing first through apertures 36, in vertical member 20 and then into screw receiving apertures 48, **48*a* in bottom cross-brace 47 are used to fasten bottom front cross-brace 47 to the interior surface 32 of vertical member 15 in such manner that each end of bottom crossbrace 47 abuts against the three interior planar surfaces of lower U channel brace 22**.

Figure 7:
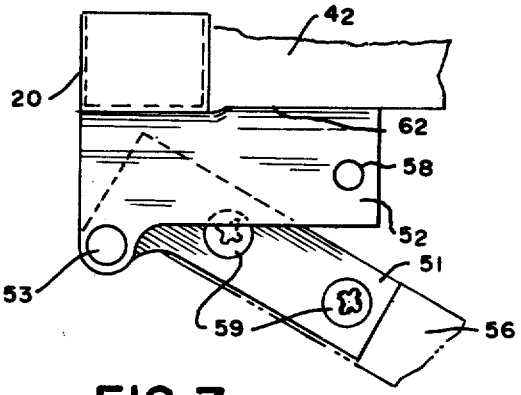
FIG. 7 is a partially fragmented top plan view of the hinge illustrated in FIG. 6.
Figure 8:
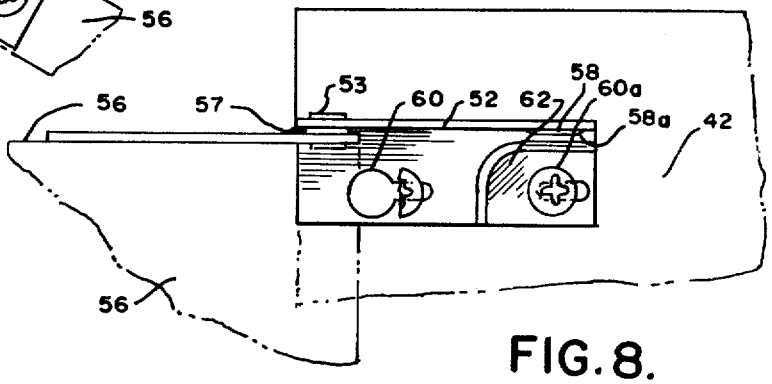
FIG. 8 is a side elevational view of the hinge illustrated in FIGS. 6 and 7.
Figure 12:
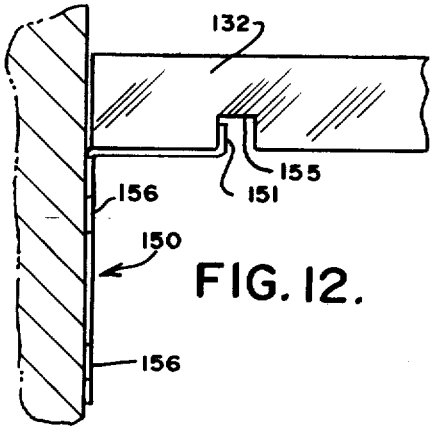
FIG. 12 is a side elevational view of a metal hanger for attaching the wall cabinet of FIG. 9 to a wall surface.

Conveniently, the next assembly operation entails mounting of hinges 50 at the bottom edge and at the top edge of door 56 indicated in FIGS. 6, 7 and 8. As there illustrated hinge 50 is mounted on the left top edge **56*a* of door 56 and to the front surface of vertical member 20. Hinge 50 comprises a door flat leaf 51 having a lateral projection 54 extending outwardly beyond the exterior face of door 56. Cabinet leaf 52 has an L cross-section shape, one angle side of which has a lateral projection 55 extending outwardly to the same extent as projection 54 on flat cabinet leaf 51 and the other angle side of leaf 52 has slotted apertures 60, 60*a* to provide, upon insertion of screws (not shown), lateral alignment adjustment of door 56 to the cabinet frame 15. A pivot pin 53 located in the lateral projection areas 54,55 of the two leaves establishes an axis of rotation for door 56. Pivot pin 53 is upset at each end to securely fasten together both leaves 51 and 52 with cabinet leaf 52 being superimposed on door leaf 51. A nylon washer 57 or similar low friction plastic washer such as polyethylene or polytetraflourethylene located between the two hinge leaves and held in place by pivot pin 53. Washer 57 serves to minimize friction impeding movement of door 56. Cabinet lead 52 towards its end opposite to its lateral projection 55 has a stamped indentation 58 forming on the other side thereof a small projection 58*a* having a height slightly in excess of the thickness of plastic washer 57 in order that when door 56 is closed against the cabinet frame, the pressure applied by projection 58*a* against the exposed surface of door leaf 51 tends to hold door 56 in a closed position. A further feature of hinge 50 is the stamped planar depression 62 on the side angle of cabinet lead 52 which attaches to the cabinet frame 15, said depression being located at the end thereof opposite lateral projection 55. Planar depression 62 projects rearwardly a sufficient distance to bear directly against the front surface of front cross brace 42 which is set back from the front end of vertical member 20 a distance equal to the thickness of the sheet metal of the vertical member. This set back exaggerated for purposes of clarity is illustrated in FIG. 7. In the absence of planar projection 62, tightening of the screw passing through aperture 60*a* would cock hinge 50 from its desired flat to flat position against the flat front surface of vertical member 20**.

Figure 9:
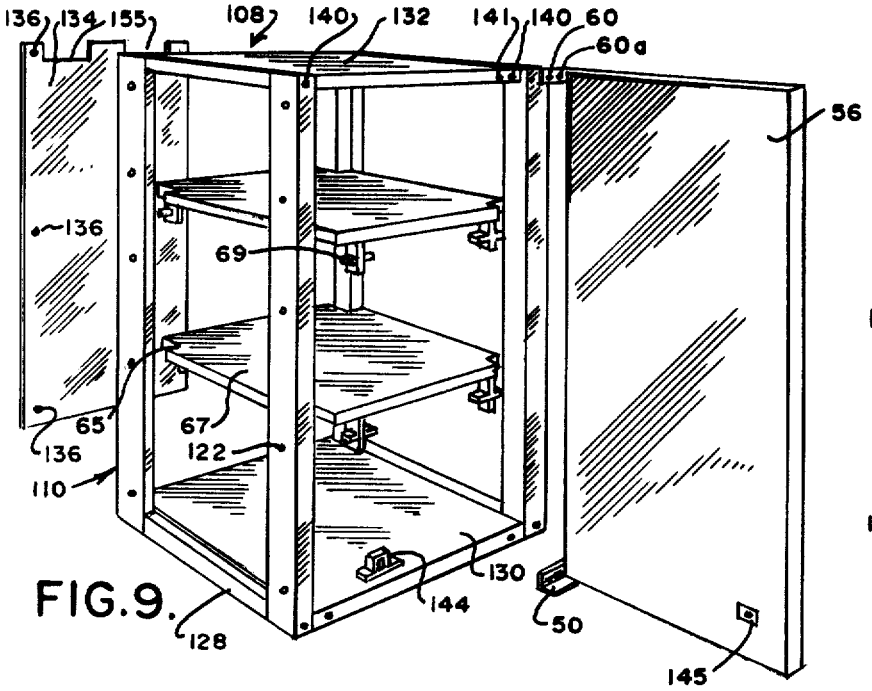
FIG. 9 is an exploded perspective view of another embodiment of the present invention showing a composite metal and wood wall cabinet assembly with a plurality of wood shelves.

The configuration of hinge 50 as illustrated in FIGS. 6, 7 and 8 adapts it to be used as the top door hinge when mounted on the left side of door 56 or as the bottom door hinge when mounted on the right side of door 56. Adaptation of hinge 50 to function as the bottom hinge on left side door mounting or the top hinge for right side door mounting merely involves during manufacture repositioning the lateral projection 55 on cabinet leaf 52 from its left end position as shown in FIGS. 7, 8 and 9 to the right end and similarly reversing the position of stamped indentation 58 and planar offset 62. Door leaf 51 is simply inverted whereby its outer planar surface becomes the inner surface in contact with the door edge.

After hinges 50 have been mounted on the top and bottom edges of door 56 and secured in position by screws (not shown) inserted through apertures 59 of hinge door lead 51, door 56 can then be attached to the front of one of the vertical members 20, after removal of the untightened screw previously inserted in aperture 37 on the hinge side vertical member 20 to temporarily position one end of upper front cross brace 42. The removed screw is first inserted into aperture 60 in cabinet leaf 52, then into aperture 37 in front vertical member 20 and then into screw receiving aperture 45 of upper front cross member 42. Another screw (not shown) is inserted in apertures 60a of cabinet leaf 52 and then into screw receiving aperture 45a of upper front cross member 42. Once these two screws have been tightened, cabinet leaf 52 is securely fastened to two cabinet frame members (20,42) and in turn frame members 20, 42 are rigidly locked together whereby both frame members function together in preventing cabinet frame distortion from the weight of the door.

A second hinge 50 is similarly fastened to the bottom edge of door 56 and to front vertical member 20 and bottom front cross-brace 47 with two screws (not shown). One screw being first inserted through aperture 60 of door hinge leaf 52, then through aperture 36 in vertical member 20 and there into screw receiving aperture 48a in bottom front cross brace 47. The other screw is first inserted through aperture 60a of door hinge leaf 52 and then into screw receiving aperture 46, in bottom cross-brace 47.

Bottom wood shelf 64 having reentrant angle cutouts 65 at each of its four corners has a length and breadth substantially equal to the overall breadth and length established by the cabinet metal side frame members 15 and horizontal front braces 42, 47 and thus rests on the top surfaces of lower front cross brace 47 and both lower U channel side braces 22, 22. Reentrant right angle cut-outs 65 or notches in shelf 64 are of such dimensions that one arm of the right angle is adjacent to the shorter U leg 28 of vertical member 20 and the other arm of the right angle is adjacent to the right angle bend 30 on said leg. To facilitate entry of bottom shelf 64 within the cabinet framework, the shelf is held at an angle from the horizontal while the lower edge thereof is positioned between the two vertical members 20, 20 of a metal side frame 15, and then the opposite edge of the shelf is lowered until it also is positioned between the two vertical members 20, 20 of the other metal side frame 15. One or more other wood shelves 67 having a reentrant right angle cut-out 65 on each of its four corners can be similarly installed in the cabinets at selected elevations and suspended therein by shelf supporting brackets 69 having a shaft extension insertable into apertures 71 punched through the shorter U leg 28 each vertical member 20. Shelf brackets 69 may be of metal or plastic material as for example molded nylon.

Figure 17:
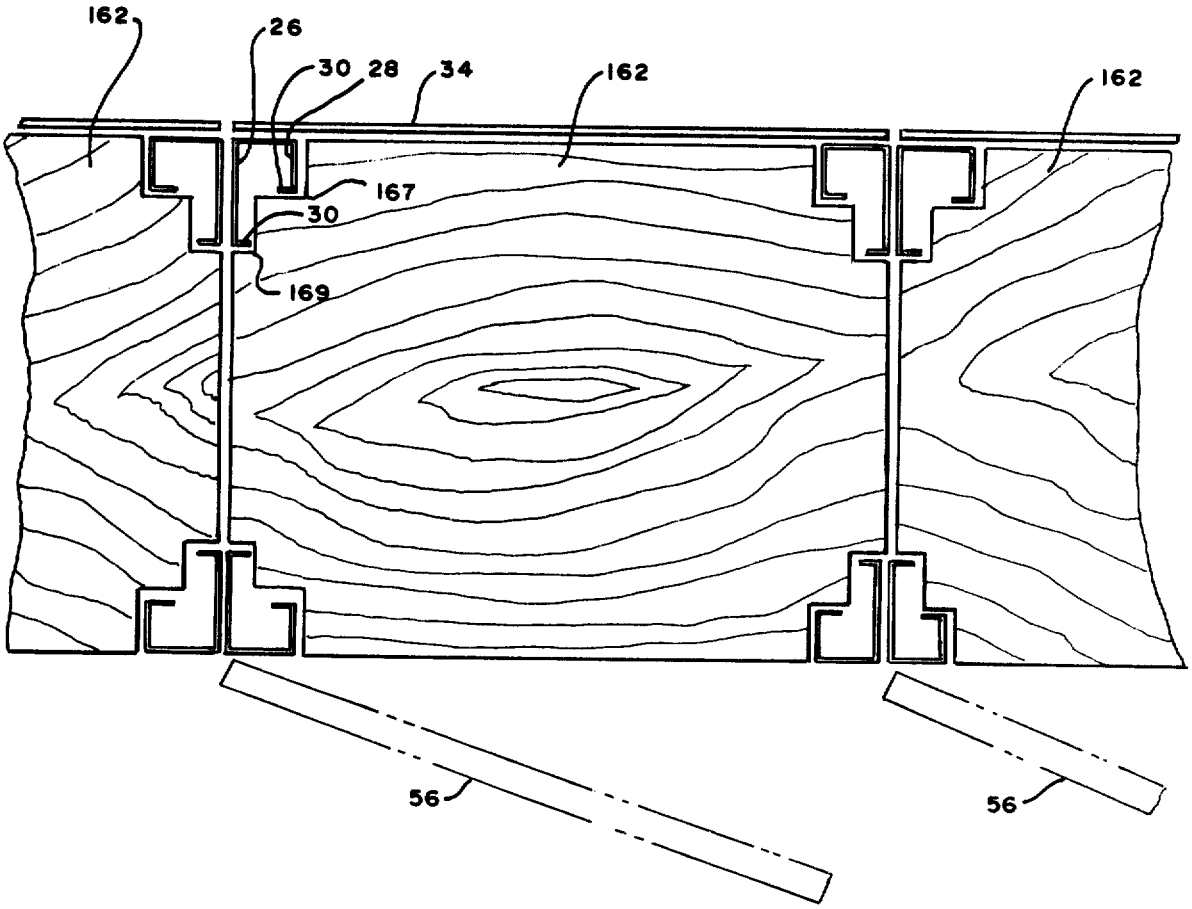
FIG. 17 is a fragmentary top view of a plurality of cabinets joined side to side and each having a shelf abutting against a shelf in an adjacent cabinet to form a substantially continuous shelf running through the interior of each set of cabinets.

As an alternate to the wood shelves 67 shown in FIGS. 1 and 9, attention is directed to the wood shelves 162 shown in FIG. 17. Shelves 162 each have two progressive right angle reentrant cut outs or notches 167, 169 at each of the four corners of said shelves whereby the edges of first right angle cut out 167 respectively bear against the exterior surface of short U leg 28 of vertical member 20 and right angle bend 30 on said U leg and the edges of the second right angle cut out 169 bear against the terminal edge of the right angle bend 30 on longer U leg 26 and the exterior surface of said right angle bend, and with the side edge of shelf 162 being flush with the exterior surface of long U leg 26. In as much as there are no side panels attached to the metal side frames of the cabinets shown in FIG. 17, it is therefore feasible to insert in anyone of the cabinets an article having a longer length then the front width of an individual cabinet and have it extend through the open area of metal side frames 15 or 110 into one or more adjacent cabinets and thereafter be able to fully close any doors attached to said cabinets. Furthermore it is rather obvious that the close abutting relationship of the several shelves 162 to each other in the several cabinets significantly contributes to the overall stiffness and rigidity of the cabinets. Installation of shelves 162 is conducted in essentially the same manner previously described for installation of shelves 67.

Means for supporting one or more drawers in cabinet 10 are a pair of metal drawer rails 73, one for each side of the drawer. Rails 73 have an U cross-sectional shape and have a length extending for the depth of cabinet 10. Apertures (not shown) at the ends of rails 73 register with rectangular shaped apertures 75 in shorter U leg 28 of vertical member 20 and enables rails 73 to be fastened against said leg by means of a speed clip or spring nut (not shown) hooked into aperture 75. Screws (not shown) are inserted first through an aperture in rail 73, next through aperture 76 in vertical member 20 and then through the threaded screw receiving flange of the speed clip. Additional drawer rails 73 may if desired be mounted at lower elevations in the cabinet corresponding to the placement of other rectangular shaped, speed clip receiving apertures 75 as shown in FIG. 2 whereby a cabinet can be assembled having only a plurality of drawers or a combination of a plurality of drawers and of shelves, or exclusively shelves.

A preferred drawer 77 for use in the cabinets of this invention is illustrated in FIGS. 4a and 4b. Drawer 77 comprises a side forming metal stamping 79 having on its upper edge an outwardly extending reinforcing flange 95 along its length. The bottom edge of stamping 79 has been press-formed to produce a U cross-sectional shaped channel 83 which provides a slot into which wood drawer bottom 81 can be inserted. Side metal stamping 79 can be shipped flat to reduce shipping bulk. When assembly begins at the site for the cabinet, the portion of the stamping which will form the rear side of the drawer is bent at right angles at the points 84 where reinforcing flange 95 and channel 83 have been precut, and drawer front mounting flanges 93 are bent outwardly at a right angle. Wood drawer front 85 is secured by screws to flanges 93 after handle 87 has been attached by screws to the front face of drawer front 85. Angle bracket 89 is screw attached to the lower edge of the rear face of drawer front 85, and supports the bottom surface of wood drawer bottom 81 after it has been inserted into the slot of U channel 83. A nylon plastic clip drawer slide 91 is snapped into a clip receiving notch 92 in U channel 83 near the rear of the drawer. The forward end of drawer 77 is supported by another drawer slide 91 snapped into a notch (not shown) at the forward end of drawer rail 73. The upper face of angle bracket 89 is screw attached to the bottom surface of wood drawer 81.

An alternative drawer 97 of conventional construction but suitable for use in the cabinets of this invention is illustrated in FIG. 5. This drawer of all sheet metal construction except for its wood drawer front 85 cannot be shipped in the flat but must be preassembled at the factory and requires resistance welding of the metal sheet 98 forming the bottom and two sides to two shaped metal bottom rails 99 and to a metal rear side panel 100. Because of the bulkiness of preassembled drawer 97 as compared to the flat packaging possible with drawer 79 of FIGS. 4a and 4b, drawer 97 is more expensive to ship.

During the next assembly step metal angle top rails 102 are each fastened to the top ends of vertical members 20 by passing bolts (not shown) through apertures 103 in top rails 103 and through apertures 104 near the top end of vertical members 20. The bolts are then each secured with a lock nut (not shown). The angle top rails 102 function as a mounting surface for a wood top or plastic panel or for a countertop. As shown in FIG. 1 there are no side panels attached to metal side frames 15 because base cabinets when used in kitchens extend from wall to opposite wall and thus the sides of cabinets 10 are not visible. However, if the positioning of cabinet 10 in a room does not expose one or both sides, panels of plywood, fiber board, or plastic laminates can be screw attached to the sides.

As a finishing and protective means against accidental kicking of front cross-brace 47 a protective panel 63 of a plastic laminate, or of sheet metal e.g. brass, extruded aluminum or chrome plated steel having on its back surface a pressure sensitive adhesive can be pressed against the exposed surface of front bottom cross-brace 47 and held in place by the adhesive.

Figure 10:
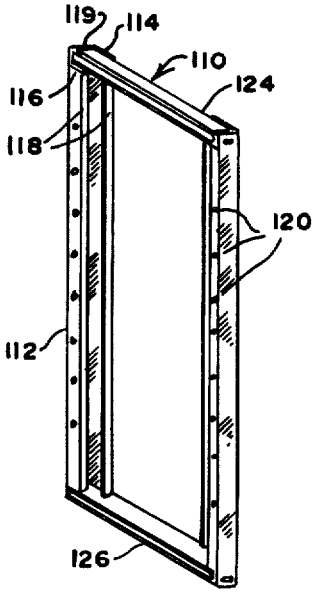
FIG. 10 is a perspective view of a sheet metal side frame as used in the cabinet assembly illustrated in FIG. 9.
Figure 11B:
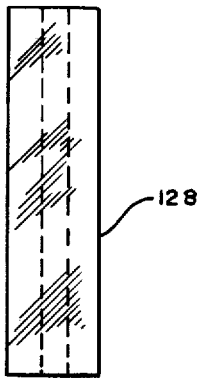
FIGS. 11*a* and 11*b* are respectively plan views of the sheet metal blanks prior to being shaped as by bending to form each of the vertical members and both top and bottom cross braces of the side frames illustrated in FIG. 10.

A further embodiment of the invention incorporating the basic featues of the previously described metal side frames 15 is illustrated in FIGS. 9, 10 and 11 depicting a cabinet 108 which is normally attached to a wall surface and hence this type is referred to as wall cabinets by the trade. The rectangular metal side frames 110 for cabinet 108 best shown in FIG. 10 comprises two spaced vertical members 112 each having a modified U shaped cross-section extending practically for the full length of the member except for small end portions to be described subsequently. The modified U shape consists of two legs 114, 116 of the U, one leg 116 being shorter than the other leg 114 and each leg having a terminal right angle bend 118 extending partly across and parallel to the base of the U. The longer leg 114 of the U cross-section constitutes the exterior face and the shorter leg 116 the interior face of metal frame 110. Apertures 120 spaces along the length of short U leg 116 are for the purpose of receiving shelf supporting brackets 69. Apertures 122 in long leg 144 are used when two cabinets are to be hung side by side and fastened together by nuts and bolts inserted through apertures 122.

Figure 11A:
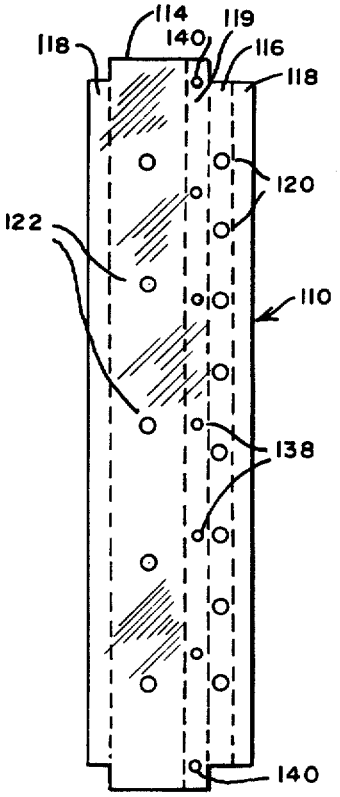

As shown in FIG. 11*a* the vertical member 112 is formed from a stamped sheet metal strip. The stamping operation cuts out apertures 120, 122 and 138 and in addition shears off at each end portion a short section of the right angle bend 118 on the long leg 114 of the U and a short section of the short leg 116 including its right angle bend 118. The dashed lines in FIG. 11*a* indicate where the metal strip is bent in a series of right angles to form the modified U shaped cross section observable in FIG. 10. Vertical members 112 are joined in parallel spaced apart relationship by horizontal upper and lower U channel cross braces 124, 126 respectively prepared from the flat metal strip depicted in FIG. 11*b* bent as indicated at right angles on the dashed lines to form the modified U cross section shaped channel. Each cross brace 124, 126 is end-lap fastened as by welding to the end portions of vertical members 112 which have no right angle bend on the longer U leg 114 and which are devoid of the shorter leg 116 and its right angle bend 118, in such manner that the exterior U base surfaces of braces 124, 126 make a welding contact with the interior faces of the longer U leg 114 of vertical members 112, and the ends of each cross brace 124, 126 abut against the interior surface of the U base 119 in vertical member 112.

Assembly of cabinet 108 is initiated by sliding one side of rectangular shaped bottom wood panel 130 into the slot of bottom U channel cross brace 126 and rectangular shaped top wood panel 132 into the slot of the top U channel cross brace 128 of one of the metal side frames 110. The opposite sides of panels 130 and 132 are respectively inserted into corresponding slots of the opposite metal frame 110. Panels 130 and 132 each have a thickness corresponding to the width of the U base 128 in metal channel braces 126 and 128 in order to provide a strong snug fit of the respective parts.

In the nest assembly step a back panel 134 of wood or metal having apertures 136 about its perimeter is fastened to the rear of cabinet 108 by screws (not shown) passing through apertures 136 of panel 134 and apertures 140 in the U base section 119 of vertical member 112 and then into the rear edges of wood panels 130, 132. Additional fastening of back panel 134 to the rear of cabinet 108 is performed by inserting sheet metal screws (not shown) through apertures 136 in panel 134 and into screw receiving apertures 138 in the U base section 119 of vertical member. Screws (not shown) are then inserted in apertures 140 in the left front vertical member 112 and into the front edges of wood base and top panels 130, 132 respectively.

Hinges 50 as previously described are right side mounted on the top and bottom edges of door 56 and then each attached to the front right side of cabinet 108 by two wood screws (not shown), one screw being inserted first through aperture 60 of hinge 50, then through aperture 140 in front vertical member 112 and then into the front edges of wood base and top panels 130, 132 respectively. The other wood screw is inserted through aperture 60*a* of hinge 50 and screwed into screw receiving apertures 141 at the front edges of panels 130, 132. Optionally a magnetic catch 144 can be installed on the upper surface of wood bottom panel 130 and a catch plate 145 on the rear face of door 56 so aligned thereon to mate with magnetic catch 144 upon the door being closed.

Rectangular shaped wood shelves 67 having reentrant right angle cut-outs 65 on each corner as previously described are positioned in the cabinet and are supported on shelf supporting brackets 69 whose shaft extension is inserted into apertures 120 of vertical metal member 112. If cabinet 108 is to be wall mounted, shelf installation is preferably postponed until after cabinet 108 has been secured to a wall surface in order to facilitate the mounting operation which employs a pair of hanging brackets 150 and a pair of clamping brackets 152.

Figure 13:
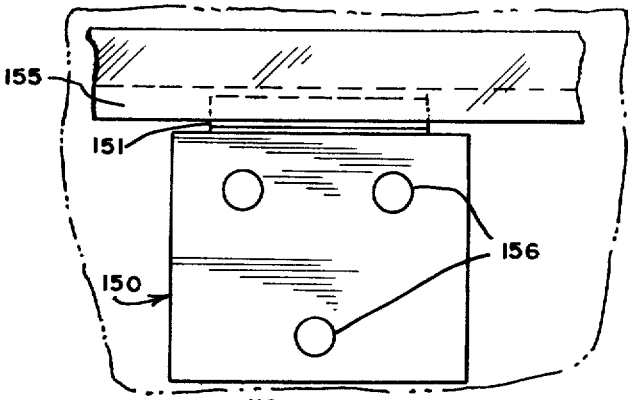
FIG. 13 is a front elevation of the metal hanger illustrated in FIG. 12.
Figure 14:
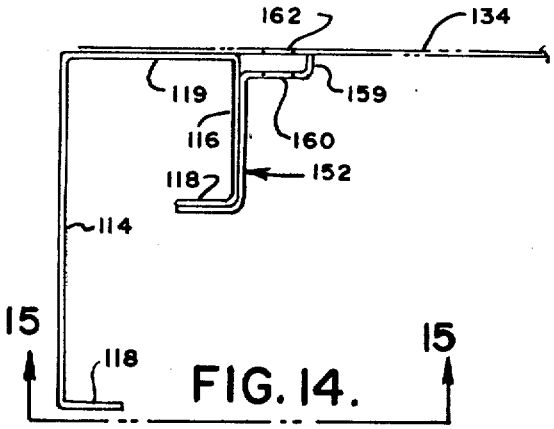
FIG. 14 is a top plan view of a metal clamp for clamping the wall cabinet of FIG. 9 to a wall surface.
Figure 15:
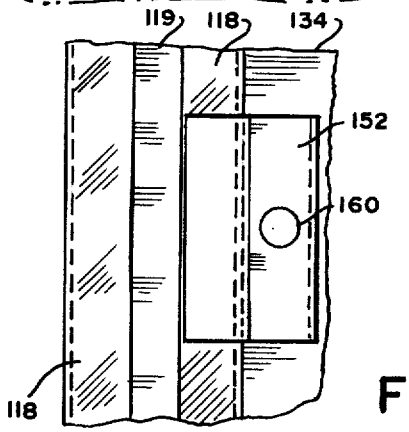
FIG. 15 is a front elevational of the clamp illustrated in FIG. 14; viewed in the direction of line 15—15 in FIG. 14.

The metal hanging bracket 150 as illustrated in FIGS. 1, 2 and 13 has a right angle shape with an upturned lip 151 on one edge thereof for engagement with a plough cut slot 155 extending across the bottom surface of top panel 132 and spaced parallel from back panel 134. Hanging bracket 150 is fastened to a wall surface be screws (not shown) passing through apertures 156 in the vertical leg of bracket 150 and into the wall. U shaped cut-outs 155 at the top end of back panel 134 provide a passageway for entry of the horizontal leg of hanger bracket 150 into the interior of cabinet 108 whereby the brackets lip 151 can be brought into engagement with slot 155 in top panel 132. Once thus engaged the horizontal leg of bracket 150 prevents downward movement of cabinet 108 and bracket lip 151 inhibits fore and after movement. Metal clamping bracket 152 provides further assurance against downward or fore and after movement of cabinet 108. As best shown in the cross section view in FIG. 14, bracket 152 has a projection running parallel with surface 116 of vertical member 112, a right angle band running parallel to bend 118 of vertical member 112, a reverse right angle bend running parallel to back plate 134 and an upturned lip 159 to bear against the front face of back panel 134. Clamping bracket 152 is fastened to a wall surface by means of a screw (not shown) passing through aperture 160 in bracket 152, then aperture 162 in back panel 134, and finally into a room wall. When thus fastened, the right angle bend on bracket 152 running parallel to bend 118 on vertical member 112 applies rearward directed pressure against bend 118 forcing the rear of cabinet 108 firmly against the room wall surface while the screw passing through aperture 160 of bracket 152 and apertures 162 of back panel 134 further sustains cabinet 108 against downward movement.

Figure 16:
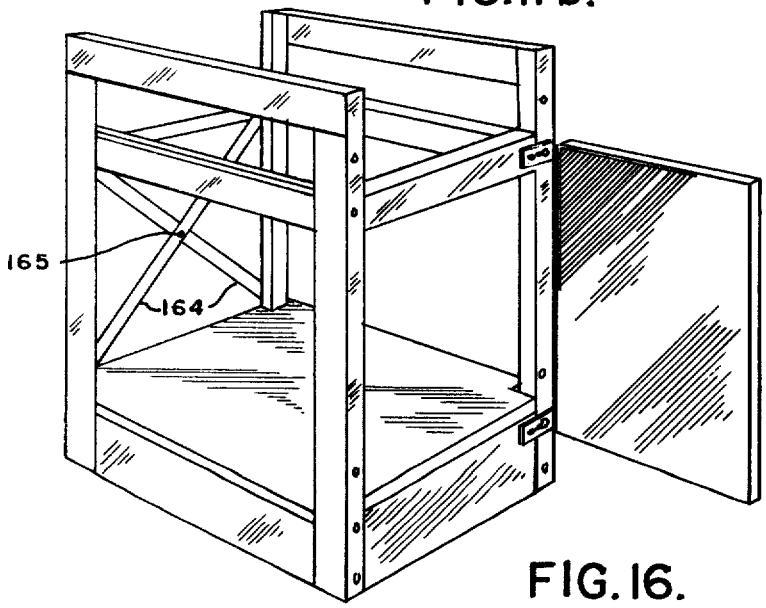
FIG. 16 is a perspective view of a base cabinet otherwise identical to the base cabinet illustrated in FIG. 1 with the exception that adjustable metal cross-bracing had been substituted for the rear panel of FIG. 1.

It is of course quite apparent that the metal side frames 15 of base cabinet 10 and side frames 110 of wall cabinet 108 can be used without alteration in the assembly of cabinets of any desired width, which is determined only by the dimensions of the front cross members 47, 42 top and bottom panels 132 and 130 respectively and back panels 34 and 124. In order to avoid the need for a plurality of different width back panels 34 and 134, an alternate means for providing adjustable back bracing support is shown in FIG. 16 as installed in a base cabinet otherwise identical to cabinet 10 in FIG. 1. The adjustable back bracing means comprise a pair of equal length metal bars 164 held together at their mid points by a rivet 165 but otherwise free to rotable. Apertures (not shown) at the end of each bar enable screws to be inserted therein and in turn through selected screw receiving appertures 138 spaced along the length of vertical member 112. By opening or closing the angular position of the two bars 164, a narrower or wider spacing of side metal frames 15 or 110 can be effected.

With a frame work utilizing metal frames as the basic load carrying and alignment means, the cabinets of this invention are stronger, more durable and easier to assemble than comparable all wood cabinets. Furthermore, no unfavorable weight penalty incurs from the employment of metal frames in as much as it has been found that the cabinets of this invention weigh practically the same as comparable all wood cabinets and in some instances even less. The term wood as used in this specification and appended claims is to be understood as inclusive of solid wood, resin bonded particle board, plywood fiber board and wood substitutes such as plastic laminates. It is also to be understood that the invention is not restricted to the specific preferred embodiments disclosed in the specification, but extends also to those modifications readily apparent to those skilled in the art.

What is claimed is:

1. A composite wood and metal knockdown cabinet assembly comprising a pair of rectangular sheet metal side frames, each frame having two spaced sheet metal vertical members having along a major portion of their length a modified U shaped cross-section with one leg of the U being longer than the other leg of the U, each leg having a terminal inward right angle bend extending partly across and parallel to the base of the U, one end section and at least one other section at or near the other section at or near the other end of the vertical member having no right angle bend on the longer leg of the U, said frame having at least two spaced horizontal metal channels bridging the space between the vertical members, each channel having a U shaped cross-section throughout its length and a width corresponding to the length of the section in the vertical member having no right angle bend in the longer leg of its modified U shaped cross-section, each horizontal channel being end-lap fastened to a section of said vertical member having no right angle bend on the longer leg of the U in such manner that the U base outer surface of the metal channel is affixed to the interior surface of the longer leg of the U in the vertical member and the ends of the channel abut the vertical member's interior surface along the base of its U shaped cross-section, means attached to the rear vertical members of the side frames for cross-bracing the rear of the cabinet assembly, and horizontal structural members attached to the front vertical members of the side frames for horizontally bracing the front of the cabinet assembly and bridging the space between the front vertical members of the side frames and fastened thereto in such manner that the corner edges of the horizontal members are overlapped by the interior surfaces of those sections of the vertical member where the modified U shaped cross-section thereof contains only the base of the U and the longer leg of the U shaped cross-section is devoid of its right angle bend.

2. A composite wood and metal knockdown cabinet assembly according to claim 1 having means attached to the vertical members of the metal side frames for interiorly supporting shelves and/or drawers.

3. A composite wood and metal knockdown cabinet assembly according to claim 2 having one or more rectangular shaped wood shelves, each shelf having a reentrant right angle cut-out at each corner thereof of such dimensions that one arm of the right angle cut-out is adjacent to the shorter leg of the modified U shaped cross-section of the vertical members in the side frame and the other arm of the right angle cut-out is adjacent to the right angle bend on said leg.

4. A composite wood and metal knockdown cabinet assembly according to claim 2 wherein a wood door is attached to the front of the cabinet by a pair of hinges, each hinge having one leaf with an L shaped cross-section and a second leaf having a rectangular cross-section, said second leaf being pin pivoted on one arm of the L in the first mentioned leaf and with the other arm of the L positioned perpendicular to the plane of the second leaf and being jointly attached to the outer surface of the base of the U in the modified U shaped cross-section of a front vertical member in the metal side frame and to the horizontal structural member bridging the space between said front vertical members and with the rectangular cross-section leaf of the hinge being attached to the top or bottom edge of the wood door, and with said hinge pin being offset from the door front.

5. A composite wood and metal knockdown cabinet assembly according to claim 1 wherein one or both of the sheet metal side frames have attached to their outer surfaces a wood or metal side panel.

6. A composite wood and metal knockdown cabinet assembly according to claim 1 wherein the means for cross-bracing the rear of the cabinet assembly are a pair of metal bars pivotally center connected to each other to form an X configuration bridging the space between the rear vertical members of the metal side frames and end fastened to said vertical members.

7. A composite wood and metal knockdown cabinet assembly according to claim 1 wherein the means for horizontally bracing the front of the cabinet are a top and bottom rectangular shaped wood panels each beng inserted into the channels of opposed horizontal metal channels in the metal side frames, the corner edges of each wood panel being overlapped by and fastened to those interior surfaces of the vertical members in the side frames whose modified U shaped cross-sections contain only the base of the U and the longer leg of the U devoid of its right angle bend, the thickness of said wood panels corresponding to the interior width of the horizontal metal channels.

8. a composite wood and metal knockdown cabinet assembly according to claim 2 having one or more interiorly supported drawers wherein the means for supporting each drawer are a pair of metal angle shaped rails, each rail bridging the space between the front and rear vertical members of the sheet metal side frame, each rail being end-lap fastened to the outer surface of the shorter leg of the U in the modified U shaped cross-section of the vertical member.

9. A composite wood and metal knockdown cabinet assembly according to claim 2 wherein an angle shaped metal rail extends across the top ends of the front and rear vertical members of each sheet metal side frame and is lap fastened to the outer surface of the longer legs of the U in the modified U shaped cross-section area of the vertical members in the said side frame.

10. A composite wood and metal cabinet assembly according to claim 2 having one or more rectangular wood shelves, each shelf having two progressive first and second right angle reentrant cut outs at each corner thereof of such dimensions that one arm of the first right angle cut out is adjacent to the exterior surface of the shorter leg of the modified U shaped cross-section of a vertical member in the side frame and the second arm of the first right angle cut out is adjacent to the right angle bend on said shorter leg, and that one arm of the second right angle cut out is adjacent to the terminal edge of the right angle bend on the longer leg of the modified U shaped cross-section of the vertical member and the other arm of the second right angle cut out is adjacent to the exterior surface of the right angle bend on said longer leg.

* * * * *